US009399258B2

(12) United States Patent
Bampton

(10) Patent No.: US 9,399,258 B2
(45) Date of Patent: Jul. 26, 2016

(54) METHOD OF PROCESSING A BIMETALLIC PART

(75) Inventor: Clifford C. Bampton, Thousand Oaks, CA (US)

(73) Assignee: AEROJET ROCKETDYNE OF DE, INC., Canoga Park, CA (US)

( * ) Notice: Subject to any disclaimer, the term of this patent is extended or adjusted under 35 U.S.C. 154(b) by 1716 days.

(21) Appl. No.: 12/556,606

(22) Filed: Sep. 10, 2009

(65) Prior Publication Data

US 2011/0058975 A1 Mar. 10, 2011

(51) Int. Cl.
*B22F 7/06* (2006.01)
*B22F 3/15* (2006.01)

(52) U.S. Cl.
CPC .. *B22F 7/064* (2013.01); *B22F 3/15* (2013.01)

(58) Field of Classification Search
CPC ..... B22F 7/064; B22F 3/15
USPC ..... 428/547
See application file for complete search history.

(56) References Cited

U.S. PATENT DOCUMENTS

| | | | | |
|---|---|---|---|---|
| 3,982,934 | A | 9/1976 | Wentzell | |
| 4,023,966 | A | 5/1977 | Loersch et al. | |
| 4,039,325 | A * | 8/1977 | Buker | 420/429 |
| 4,212,669 | A | 7/1980 | Veeck et al. | |
| 4,529,452 | A | 7/1985 | Walker | |
| 4,772,450 | A | 9/1988 | Friedman | |
| 4,931,238 | A | 6/1990 | Nishio et al. | |
| 5,113,583 | A | 5/1992 | Jenkel et al. | |
| 5,284,616 | A | 2/1994 | Mattsson et al. | |
| 5,960,249 | A | 9/1999 | Ritter et al. | |
| 6,042,780 | A * | 3/2000 | Huang | 419/36 |
| 6,210,633 | B1 | 4/2001 | Kratt et al. | |
| 6,262,150 | B1 | 7/2001 | Behi et al. | |
| 6,669,880 | B2 | 12/2003 | Behi et al. | |
| 6,939,508 | B2 * | 9/2005 | Bampton et al. | 419/5 |
| 6,986,810 | B1 | 1/2006 | Behi | |
| 7,517,400 | B2 | 4/2009 | Behi | |
| 2006/0054856 | A1 * | 3/2006 | Behi | 252/62.9 PZ |

* cited by examiner

*Primary Examiner* — Weiping Zhu
(74) *Attorney, Agent, or Firm* — Joel G Landau

(57) ABSTRACT

A method of processing a bimetallic part includes depositing an intermediary material having a metal powder onto a tooling surface of a cavity of a tool, transforming the intermediary material into a metal layer having a first composition on the tooling surface, and forming a metal core having a second, different composition in the cavity such that the metal layer bonds to the metal core to form a bimetallic part.

1 Claim, 1 Drawing Sheet

METHOD OF PROCESSING A BIMETALLIC PART

BACKGROUND OF THE INVENTION

This disclosure relates to powder metallurgy processes and, more particularly, making a bimetallic composite.

Aerospace or other types of parts may be designed for operating in severe environments. In this regard, the parts may be fabricated from materials, such as superalloys, that have excellent stability in the given environment. In some cases, the parts may be bimetallic to obtain beneficial properties of multiple alloys. As an example, gas turbine engine rotors and blisks, may include a core formed from a first alloy and a protective coating formed from another alloy. The core may provide desirable mechanical properties, while the coating may provide resistance to the substances in the surrounding environment, for example.

Powder metallurgy has been used with the technique of hot isostatic pressing ("HIP") to fabricate bimetallic parts by consolidating a powdered alloy in a sacrificial tool to form the core. The interior of the tool may be directly plasma-coated with the alloy of the protective coating alloy. Upon consolidation in the HIP process, the alloy on the tool bonds to the core. When the tool is removed, the alloy remains on the core as the protective coating.

SUMMARY OF THE INVENTION

An exemplary method of processing a bimetallic part includes depositing an intermediary material having a metal powder onto a tooling surface of a cavity of a tool, transforming the intermediary material into a metal layer having a first composition on the tooling surface, and forming a metal core having a second, different composition in the cavity such that the metal layer bonds to the metal core to form a bimetallic part.

In another aspect, a method of processing a bimetallic part may include depositing a layer of an aqueous slurry having a metal powder onto the tooling surface of a cavity of a tool, drying the layer to remove water and form a dried layer, sintering the dried layer to form a metal layer of a first composition on the tooling surface, and forming a metal core of a second, different composition in the cavity such that the metal layer bonds to the metal core to form a bimetallic part.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
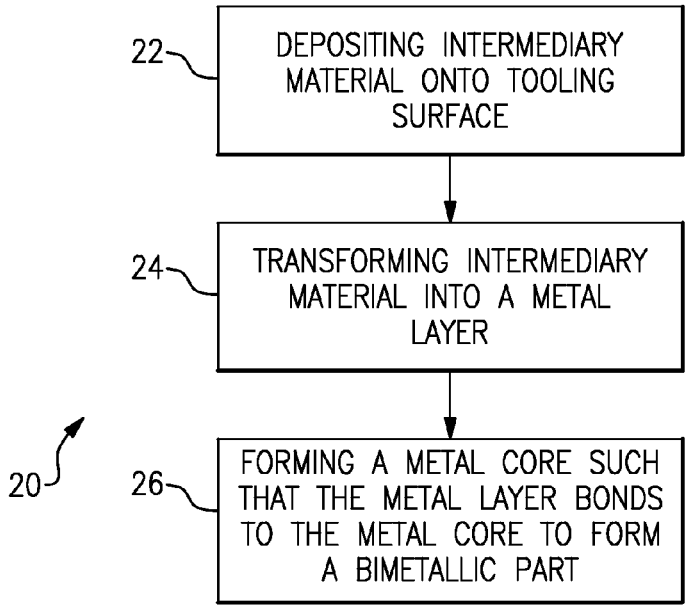
FIG. 1 illustrates an example method of processing a bimetallic part.

FIG. 1 illustrates selected steps of an example method 20 for processing a bimetallic part. As will be appreciated, the method 20 may be adapted for use with any type of part, such as an aerospace part. In some examples, the bimetallic part may be a rotor or blisk for use in a gas turbine engine, however, the method 20 is also suitable for processing other types of parts.

The method 20 includes a deposition step 22, a transformation step 24, and a formation step 26 for processing the bimetallic part. Each of the steps 22, 24, and 26 will now be described in further detail.

In general, the method 20 may be used to form a metal core of a first composition that is surrounded by a protective metal layer of a second, different composition. For instance, the metal core may be formed from an alloy, such as a nickel alloy, cobalt alloy, nickel-iron alloy, nickel-chromium alloy, stainless steel, or other type of alloy. However, the method 20 is not limited to any particular type of alloy or metal.

The protective metal layer may be any type of alloy or metal that provides resistance to the surrounding environment relative to the metal core. As an example, the protective metal layer may be a superalloy composition that is ignition resistant relative to the core. In a few additional examples, the protective material may be a low strength stainless steel (e.g., A286) for resistance to hydrogen penetration and embrittlement, a nickel alloy, nickel-chromium alloy, or nickel superalloy for resistance to oxygen-rich environments, or a stainless steel (e.g., 300 series) for resistance to peroxide-rich environments. However, given this description, one of ordinary skill in the art will recognize other types of protective materials to meet their particular needs.

The method 20 may be conducted using a tool, such as a sacrificial hot isostatic pressing ("HIP") tool. The tool may be fabricated from a suitable material, such as a ferrous alloy, and include a cavity having a tooling surface for forming the part.

Turning now to step 22, an intermediary material having a metal powder is deposited onto the tooling surface. The intermediary material may refer to any material that is in an intermediate form with regard to a final, consolidated metal layer on the tooling surface that will then become bonded to the metal core. As an example, the intermediary material may include components, such as a carrier material, that will be removed prior to forming the consolidated metal layer. In another example, the intermediate form may simply refer to a porous state of the material, such as a layer of unsintered powder particles, prior to consolidation.

The tooling surface may be designed with a contour to facilitate forming the desired shape of the part. As an example, the contour may include channels or the like that have surfaces that are angularly oriented relative to each other. The angles may be approximately perpendicular, acute, or obtuse. In any case, one premise of this disclosure is that using the intermediary material allows a uniform thickness layer of the intermediary material to be deposited onto the tooling surface, regardless of line-of-sight, feature size, or angular orientation, which facilitates forming the protective metal layer with a uniform thickness.

As an example, a non-line-of-sight deposition process may be used to deposit the intermediary material such that the intermediary material uniformly coats the angularly oriented surfaces. The term "line-of-sight" may refer to an ability of a process to deposit a material only on a surface having an unobstructed path between the surface and the source of the coating material (e.g., a nozzle). The non-line-of-sight process may include immersing the tooling surface in the intermediary material, such as by dipping, although other deposition techniques may alternatively be used. Thus, the intermediary material allows process flexibility to use a deposition technique that is suited for uniformly covering all of the surfaces and ultimately forming a protective metal layer of uniform thickness. In comparison, line-of-sight-processes, such as thermal spraying, that are used to directly deposit a metal layer on a tool surface are normally incapable of providing a uniform thickness because angled surfaces with respect to the spray direction receive less coating material than perpendicular surfaces. Moreover, channel surfaces or surfaces within internal cavities may not be coated at all using a line-of-sight process. Thus, a tool may be segmented into several pieces to provide more direct line-of-sight access to angled surfaces to improve thickness uniformity, and then later bonded together at a seam. However, segmenting and bonding may not be feasible for small or complex features and may add expense to the process. In this regard, the method 20 allows uniform coating of all surfaces without regard to line-of-sight, size, or orientation and eliminates or reduces the need for segmented tooling and may utilize a non-segmented tool with regard to bonded seams.

The intermediary material may be a slurry having a carrier mixed with the metal powder. In one example, the carrier may be water such that the slurry is an aqueous slurry. The aqueous slurry may include a relatively small amount of a binder material, such as a starch or other organic material, which can bind the metal powder particles together once the carrier is removed. In some examples, the aqueous slurry may have a composition that includes about 1.5% to about 10% by weight of a water soluble polysaccharide binder and about 0.5% to about 6% by weight of a sugar. In other examples, the aqueous slurry may have a composition that includes about 0.1% to about 3% by weight of a gelatine material, which may include glycine, proline, hydroxyproline and amino acids, for instance. Alternatively, other types of organic solvents and binders may be used. Given this description, one of ordinary skill in the art will recognize suitable slurry compositions to meet their particular needs.

In another example, the intermediary material may be a mixture of the metal powder with a polymer carrier. For instance the polymer may be melted and mixed with the metal powder. The mixture may then be deposited on the tooling surface by immersion or other suitable non-line-of-sight technique as described above.

If a thicker protective metal layer on the bimetallic part is desired, multiple layers of the intermediary material may be deposited on the tooling surface. For instance, the tooling surface may be immersed multiple times in the intermediary material to deposit multiple layers. The layers may be dried or partially dried between immersions. In any case, a single layer of the intermediary material, such as the aqueous slurry, may be used to form a metal layer that is up to about 6.4 millimeters thick. Of course, multiple layers can be applied to obtain a greater thickness. Thus, the protective metal layer can be much thicker than coatings provided by direct deposition methods, such as thermal spraying.

The viscosity of the slurry may also be selected to control coating thickness. For instance, a more viscous slurry forms a thicker layer and a less viscous slurry forms a relatively thinner layer. The amount of binder that is used may be selected to yield a desired viscosity.

After deposition, the intermediary material is transformed into a metal layer on the tooling surface in the transformation step 24. The actions taken in the transformation step 24 may depend on the type of intermediary material or carrier selected. In the case of the aqueous slurry, the layer is dried to remove the water through evaporation. The drying may be conducted through natural evaporation at ambient conditions or expedited at an elevated temperature. Other types of organic solvent carriers may be removed in a similar manner. With the removal of the water, the metal powder and the binder remain in a "green" state on the tooling surface.

Upon drying, the binder material supports the metal powder on the tooling surface. In this regard, using the method 20 with an aqueous slurry facilitates reducing introduction of impurities into the protective metal layer because the slurry only contains a small amount of the binder/additives in addition to the metal powder, and elevated temperatures are not needed to deposit the slurry. In comparison, thermal spraying can introduce oxides or other undesired phases that form at the high processing temperatures.

The tool and green state layer can then be subjected to an elevated sintering temperature to thermally remove the binder and consolidate the metal powder into a metal layer on the tooling surface. In the case of the polymer carrier, the polymer may be removed in a thermal treatment step or in conjunction with the sintering to thermally decompose the polymer. However, the polymer may leave a residue of thermal decomposition products.

After forming the metal layer, the metal core is formed in formation step 26. In this case, HIP processing may be used to form the metal core in a known manner. As an example, a powdered metal material may be deposited into the cavity of the tool and hot isostatic pressed under elevated heat and temperature conditions to form the bimetallic part. The conditions may depend on the type of powdered metal material selected. The heat and pressure consolidate the powdered metal material and also cause the metal layer on the tooling surface to bond to the surface of the metal core. As an example, the metal layer may diffusion bond to the metal core. The tool is then removed and the metal layer remains as an encasement around the metal core. The tool may be removed in a known manner, such as by depositing the tool in an acid bath that dissolves the tool.

Figure 2:
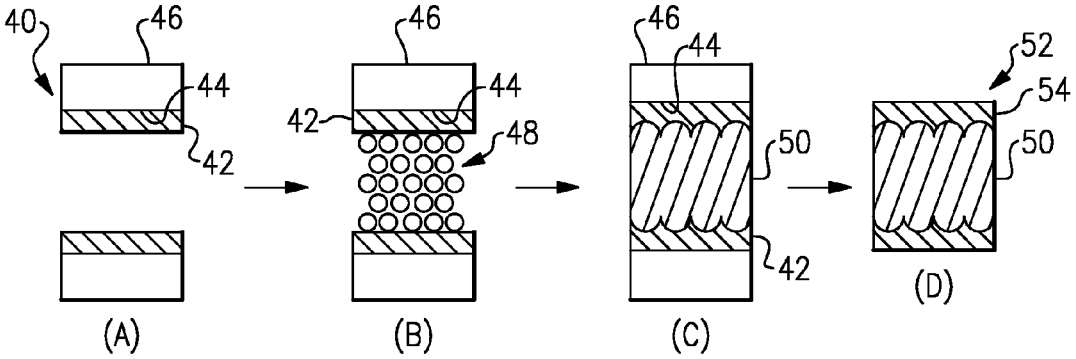
FIG. 2 schematically illustrates a workpiece through several stages of a fabrication process.

FIG. 2 schematically illustrates a portion of an example workpiece 40 at several stages, A-D, through a hot isostatic process. In this case, stage (A) illustrates the workpiece 40 with a metal layer 42 (e.g., coating) deposited on a tool surface 44 of a tool 46. The tool surface 44 may be a portion of a non-line-of-sight feature of the tool 46. That is, the non-line-of-sight feature may be a channel, internal cavity, or other type of feature that, with respect to a single view point of an observer, includes a surface which is obscured from view. The metal layer 42 may be formed according to the steps 22, 24, and 26 of the method 20. The tool 46 is then filled with a powdered metal material 48 at stage (B) and then hot isostatic pressed under heat and pressure at stage (C) to form a core 50. There may be some inter-diffusion between the metal layer 42 and the core 50, which facilitates forming a strong bond. The tool 46 is removed in a known manner at stage (D), leaving a final or near final part 52 having a protective metal layer 54 around the core 50. In this regard, the non-line-of-sight feature also includes the protective metal layer 54.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure.

The scope of legal protection given to this disclosure can only be determined by studying the following claims.

What is claimed is:

1. A method of processing a bimetallic part, comprising:

depositing an intermediary material having a metal powder onto a tooling surface of a cavity of a tool, wherein the intermediary material is slurry having the metal powder and a binder selected from the group consisting of polysaccharide, sugar, glycine, proline, hydroxyproline and amino acids;

transforming the intermediary material into a metal layer of a first composition on the tooling surface; and forming a metal core of a second, different composition in the cavity such that the metal layer bonds to the metal core to form a bimetallic part, wherein the tooling surface is contoured and non-segmented with respect to bonded seams in the tool.

* * * * *